United States Patent [19]

Weiner

[11] Patent Number: 4,753,614

[45] Date of Patent: Jun. 28, 1988

[54] CONNECTING SYSTEM FOR ELECTRICAL JACKS

[75] Inventor: Hans Weiner, Muhlacker, Fed. Rep. of Germany

[73] Assignee: Dr. Ing. h.c.F. Porsche Aktiengesellschaft, Stuttgart, Fed. Rep. of Germany

[21] Appl. No.: 9,087

[22] Filed: Jan. 27, 1987

Related U.S. Application Data

[63] Continuation of Ser. No. 634,132, Jul. 25, 1984, abandoned.

[30] Foreign Application Priority Data

Jul. 27, 1983 [DE] Fed. Rep. of Germany ..... 3326991

[51] Int. Cl.[4] ..... H01R 9/00

[52] U.S. Cl. ..... 439/717; 439/746

[58] Field of Search ..... 439/116, 117, 709, 710, 439/715, 717, 711, 712, 713, 714, 723, 724, 744, 746

[56] References Cited

U.S. PATENT DOCUMENTS

| | | | |
|---|---|---|---|
| 3,252,123 | 5/1966 | Maps, Jr. et al. | 339/198 S |
| 3,273,107 | 9/1966 | Chandler | 339/198 S |
| 4,046,452 | 9/1977 | Cassarly | 339/198 H |
| 4,139,255 | 2/1979 | Otani | 339/217 S |
| 4,184,733 | 1/1980 | Schmeling | 339/198 H |
| 4,322,120 | 3/1982 | Rilling | 339/47 R |
| 4,343,528 | 8/1982 | Lucius et al. | 339/198 G |

*Primary Examiner*—Joseph H. McGlynn

*Attorney, Agent, or Firm*—Barnes & Thornburg

[57] ABSTRACT

A connecting system is disclosed for electric connector sockets. These sockets comprise, in a recess of an insulating housing, a supported contact member, the electric conductor elements of which are connectible to a further electric conductor element of a plug inserted from the outside. Several insulating housings can be releasably plugged together into a unit by way of detent means. The detent means of each housing serve simultaneously for fixing the connector socket in the adjoining housing.

15 Claims, 1 Drawing Sheet

CONNECTING SYSTEM FOR ELECTRICAL JACKS

This is a continuation, of application Ser. No. 634,132, filed July 25, 1984, now abandoned.

BACKGROUND AND SUMMARY OF THE INVENTION

The invention relates to a connecting system for connecting together insulating housings for housing electrical plug and socket type connections.

Connecting systems for electric units, such as connector sockets etc. have been known such as described in German Published Unexamined patent application (DOS) No. 30 46 758, wherein the housings accommodating the socket are detachably linked together by detent means that can be engaged with one another, in the manner of a tongue-and-groove joint. Projections, which are formed at the side of the housing or are constituted by attachments that can be clamped thereon, are provided for retaining the socket in the housing, particularly for holding the socket while it is being connected to a plug. Housings for electric sockets constructed in this way require a relatively large structural expenditure on account of the separate means for holding the socket and for joining the housings together.

It is an object of the invention to provide a connecting system of the type discussed above which, with satisfactory efficiency and handling, can be realized by simple means.

This object has been attained according to the invention providing that such a system comprises a plurality of insulating housing means, each including: detent means and engaging means for engaging the detent means of an adjacent insulating housing to connect together adjacent insulating housings, wherein the detent means of each housing includes retaining means for retaining within an adjacent housing one of the plug and socket of the plug-and-socket-type connectors.

Additional advantageous features relate to specific constructional details described below in conjunction with the illustrated preferred embodiment of the invention.

The advantages primarily attained by this invention reside in that the housings can be clipped together in a simple way by molded-on detent noses.

At the same time, the detent noses serve for holding and retaining the connector sockets in the housing so that no additional locking means are required any longer. Any desired number of housings can be joined together into a functional unit in a simple way with the use of the detent means, whereupon the entire unit can then be attached, for example, to an installation wall of an automotive vehicle by way of the still remaining, free detent nose. It is furthermore advantageous that only a one-piece basic element is utilized, simplifying warehousing, and that, in correspondence with requirements, for example, a ten-pole, twenty-pole, etc. unit can be produced.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 2:
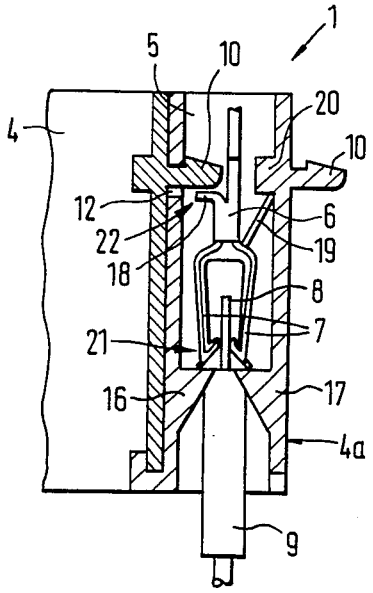
FIG. 2 is a representation in a sectional view according to FIG. 1 showing two linked-together housings constructed in accordance with a preferred embodiment of the invention with internally retained sockets fixed between projections.

The connecting system 1 comprises a plurality of insulating housings 4 linked together by way of detent means 2 and 3. A connector socket 6 is arranged within the housing 4 in a recess 5 (FIG. 2). This connector socket comprises electric conductor elements 7 which are connected to a further electric conductor element 8 of a plug 9 insertable from the outside.

Each insulating housing 4 includes the elements of the cooperating detent means 2 and 3. The detent means 2 comprises a hook-shaped nose 10 molded on a sidewall 11 of the housing 4. An opening 12 is arranged on the opposite wall 15 of the same housing 4. For connecting two housings, the nose 10 locks into the opening 12 arranged in correspondence with this nose in the proximate, adjoining housing.

Figure 1:
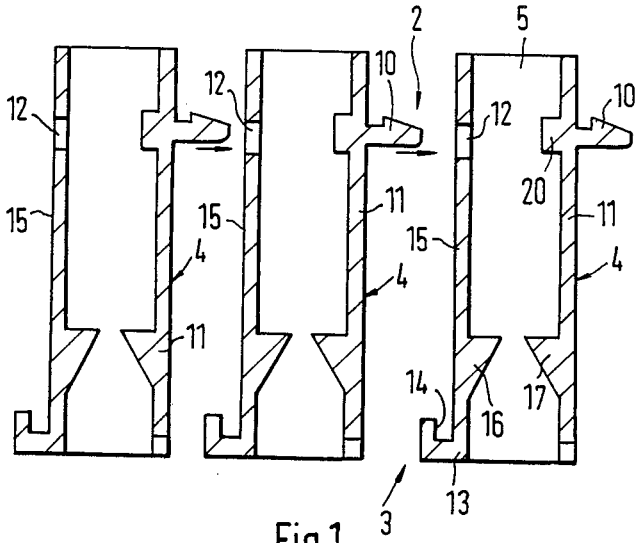
FIG. 1 is a cross sectional view through several insulating housings of a connecting system, not linked together constructed in accordance with a preferred embodiment of the invention.

The further detent means 3 is provided on the lower housing rim 13 of a sidewall and consists of a groove-like mounting 14. The latter is located in opposition to the wall 11 of the housing 4 accommodating the nose 10, as is also shown in FIG. 1.

In order to join several housings 4 into one unit, respectively the lower rim section 4*a* of the straight wall 11 of an adjoining housing is inserted in the groove-like mounting 14 and held therein in a shape-mating fashion, while the nose shaped detent 10 is inserted into the opening 12 of the same adjoining housing.

The socket 6 is supported with its lower end 21 facing the plug 9 on lateral projections 16 and 17 on the housing side. At its upper end 22, facing away therefrom, the socket 6 has a contact shoulder 18 as well as a spread-apart resilient locking tongue 19.

The contact shoulder 18 is angled with respect to the basic member of the socket 6 and, with housings in joined condition, the detent nose 10 of an adjoining housing extends over this contact shoulder, the latter being retainingly supported on this detent nose.

The locking tongue 19 of the socket 6 rests on a fixed projection 20 of the housing wall 11, which projection is formed on the latter in opposition to the introduced detent nose 10 and/or the opening 12. Consequently, the socket 6 is held clamped, on the one hand, between the lower projections 16 and 17 and, on the other hand, between the upper projection 10 (detent nose) and the projection 20, so that in case of tensile and compressive stresses on the socket, a secure retention within the housing is ensured.

According to an alternative arrangement, the detent nose can also be fashioned solely for holding the socket. The insulating housings can, in this case, be plugged together by way of detent means wherein there is no simultaneous fixation of the socket in the housing.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A connecting system for connecting together insulating housings for housing electrical connector means comprising a plurality of insulating housing means, each including:

detent means and a detent engaging means for engaging the detent means of an adjacent insulating housing to connect together adjacent insulating housings;

wherein the detent means of each housing includes retaining means for retaining said connector means within an adjacent housing, wherein each retaining means includes a first internal projection means having a contact shoulder engageable with said connector means for preventing movement of said connector means in a first axial direction, and wherein each housing further comprises a second internal, lower projection means engageable with the connector means at an axial spacing from the engagement by the contact shoulder of the first internal projection means with the connector means for preventing movement of said connector means in a second axial direction.

2. A connecting system according to claim 1, wherein the engaging means for engaging the detent nose means comprises means defining an opening in a wall of the adjacent housing, and wherein each internal projection means is on the housing arranged opposite to the opening, the connector means further including a locking tongue biased away from the connector means, the locking tongue engaging the upper projection means to further retain the connector means within the housing.

3. A connecting system for connecting together insulating housings for housing electrical connector means comprising a plurality of insulating housing means, each including:

detent means and counter detent means for engaging the detent means of an adjacent insulating housing to connect together adjacent insulated housings, wherein the detent means of each housing includes a first detent portion which engages counter detent means of an adjacent housing to lock the housing with the adjacent housing, said first detent portion and counter detent means including respective abutting shoulder surfaces which extend transversely of the engaging direction of said first detent portion with said counter detent means for limiting movement of said housings with respect to each other in a direction normal to the abutting surfaces, said first detent portion simultaneously serving to directly engage said connector means for limiting movement of said connector means within an adjacent housing.

4. A connecting system according to claim 3, wherein the detent means of each housing comprises a second detent portion defining a groove for engaging a wall of an adjacent housing.

5. A connecting system according to claim 3, wherein said first detent portion is formed as a hook shaped nose insertable through said counter detent means of the adjacent housing.

6. A connecting system according to claim 5, wherein said hook shaped nose is molded on a side wall of the housing and said counter detent means includes an opening in the wall of an adjacent housing.

7. A connecting system according to claim 6, wherein each hook-shaped nose forms a first internal projection means in the adjacent housing and the connector means includes an angled contact shoulder means, the first internal projection means extending over and engaging the angled contact shoulder means when the housings are in the connected condition, wherein the adjacent housing further comprises a second internal lower projection means, and wherein the connector means is positioned within each housing between the first internal projection means of the first detent portion of an adjacent housing and the second lower projection means of each housing.

8. A connecting system according to claim 7, wherein each housing further comprises a third internal upper projection means on said adjacent housing arranged opposite to the opening, the connector means further including a locking tongue means biased away from the connector means, the locking tongue means engaging the upper projection means to further retain the connector means within each housing.

9. A connecting system according to claim 3, wherein the first detent portion forms a first internal projection means in the adjacent housing when in the connected condition and the connector means includes an angled contact shoulder means, the first internal projection means extending over the abutting the angled contact shoulder means, wherein the adjacent housing further comprises a second lower projection means, and wherein the connector means is positioned within each housing between the first internal projection means of the first detent portion of an adjacent housing and the second lower projection means of each housing.

10. A connecting system according to claim 9, wherein the counterdetent means comprises means defining an opening in a wall of the adjacent housing for accommodating insertion of the first detent portion, and wherein the adjacent housing further comprises a third internal upper projection means on said adjacent housing arranged opposite to the opening, the connector means further including a locking tongue means biased away from the connector means, the locking tongue means engaging the third upper projection means to further retain the connector means within the adjacent housing.

11. A connecting system according to claim 10, wherein said first detent portion includes a hook-shaped nose molded on a side wall of the housing.

12. An electrical connection arrangement comprising a plurality of insulated housings for accommodating connector means, each housing being formed in one piece and including:

wall means for surrounding said connector means, said wall means including a first wall portion having a first opening and a second wall portion having an outwardly protruding detent nose molded thereon which is snap fittingly lockingly engageable through the first opening of an adjacent housing to lock said housings together, and a first abutment means protruding inwardly from said wall means to form a first axial abutment for preventing movement of said connector means in a first axial direction, wherein said detent nose serves as a second axial abutment facing the first axial abutment and spaced therefrom for preventing movement of said connector means in a second axial direction with said connector means retained in said housing between said first and second axial abutments.

13. An arrangement according to claim 12, wherein said second wall portion exhibits an inwardly projecting third axial abutment which is engageable with a resilient locking tongue of the connector means to further retain the same in position within the housing.

14. An arrangement according to claim 13, wherein said connector means includes a contact shoulder abuttingly engageable with the detent nose.

15. An arrangement according to claim 13, wherein said wall means includes an outwardly extending lateral projection having at its end an upwardly directed flange for forming a groove for accommodating engagement with an adjacent housing.

* * * * *